United States Patent [19]

Golas et al.

[11] 4,238,227

[45] Dec. 9, 1980

[54] CLEANSING OF STEEL BY GAS RINSING

[75] Inventors: Eugene A. Golas, Middletown Township, Bucks County; Robert A. Rege, Hempfield Township, Westmoreland County, both of Pa.

[73] Assignee: United States Steel Corporation, Pittsburgh, Pa.

[21] Appl. No.: 52,882

[22] Filed: Jun. 27, 1979

[51] Int. Cl.[3] ..... C21C 7/02

[52] U.S. Cl. ..... 75/58; 75/53; 75/59

[58] Field of Search ..... 75/53, 58, 59

[56] References Cited

U.S. PATENT DOCUMENTS

| | | | |
|---|---|---|---|
| 3,575,695 | 4/1971 | Miyashita | 75/58 |
| 3,702,243 | 11/1973 | Miltenberger | 75/58 |
| 3,754,591 | 8/1973 | Bales | 75/58 |
| 3,769,004 | 10/1973 | Barnhardt | 75/58 |
| 3,885,957 | 5/1975 | Richter | 75/58 |
| 3,980,469 | 9/1976 | Forster | 75/58 |
| 3,992,195 | 11/1976 | Klapdar | 75/58 |
| 4,066,444 | 1/1978 | Kosmider | 75/58 |

OTHER PUBLICATIONS

Gerasimov, "Treatment of Metal in the Ladle With Inert Gas," pp. 33–34 (Jan. 1970).

Torsell, "The Effect of Clustering or the Elimination of $Al_2O_3$ Inclusions Introduced the Aluminum Deoxidation of Liquid Steel", (Jul., 1970).

Nemoto, et al., "Operation and Technical Development of Wide Slab Continuous Caster at Nippon Kokan", pp. 13–18 (1949).

Holmes, "Argon Degassing of Seamless Tubular Steels", *Journal of Metals*, pp. 22–30 (Jun., 1973).

*Primary Examiner*—P. D. Rosenberg

*Attorney, Agent, or Firm*—Forest C. Sexton

[57] ABSTRACT

A method for deoxidizing steel to effect exceptional cleanliness wherein a relatively high amount of aluminum is added to the tap ladle before the first one-third volume of steel is tapped, and then adding conventional deoxidizers while the final two-thirds volume of steel is tapped. Argon is subsequently blown through the steel at a rate not exceeding 10 scfm for a period of about nine to twenty minutes.

4 Claims, No Drawings

CLEANSING OF STEEL BY GAS RINSING

BACKGROUND OF THE INVENTION

Argon stirring of molten steel for temperature homogenization is well known in the art. In such processes, low volumes of an inert gas, such as argon, typically 0.03 to 0.06 $m^3$/ton, are injected into a ladle of steel to cool the steel to a uniform and suitable temperature for continuous casting. A common technique is to immerse a lance or a hollow dummy stopper rod through which argon gas is admitted for a period of three to five minutes at about 10 scfm (0.3 $m^3$/min.). It is generally recognized that uncontrolled argon stirring may have a deleterious effect in that excessive agitation may excessively expose the steel to the atmosphere or oxidizing slag to reduce the steel's cleanliness.

Argon degassing is another well known procedure wherein generally large amounts of an inert gas, such as argon, i.e. ten to twenty times the amount used in stirring, are blown through a molten steel to reduce the oxygen and hydrogen content. These procedures usually require rather sophisticated equipment, and treatment costs are relatively high.

Argon trim stations have been reported where final deoxidant or alloy additions are made in the ladle during or after argon stirring. The stirring action is usually very turbulent. The argon treatment is used to assist in mixing the deoxidant or alloy addition, thus achieving better recovery of the added elements, and is intended to produce chemical and temperature homogeneity.

While uncontrolled argon injections may adversely affect the steel's cleanliness, it has been recognized that controlled argon injection into molten steel may serve to remove some of the non-metallic inclusions, such as oxides and sulfides. Such a cleansing action, however, is minimal, and in no way comparable to the various vacuum degassing processes. That is to say, that while low volume argon flushing practices have been developed to mix a molten steel, the degree of cleanliness achieved is in no way comparable to that effected by conventional vacuum degassing practices, such as DH-degassing. For example, one study has shown that for a particular electric furnace steel grade containing 0.21 to 0.30% carbon, the uncleansed product contained an average oxygen content of 121 ppm. The product oxygen content was reduced to 114 ppm with conventional argon stirring, while the product oxygen for DH-degassed samples averaged 69 ppm.

It has been unfortunate that argon flushing practices cannot be substituted for vacuum degassing because, as the demand for high quality steels increases, many steel mills are experiencing a shortage of vacuum degassing capacity.

SUMMARY OF THE INVENTION

This invention is predicated on our conception and development of a modified argon rinsing practice wherein controlled additions of aluminum are added before other deoxidizers during tapping. A suitable argon rinse thereafter will yield a much cleaner steel than possible with conventional argon flushing practices. The inventive process is so effective that the resulting steel is as clean or cleaner than those processed through vacuum degassing equipment. Therefore, the argon rinsing process of this invention can be substituted for vacuum degassing in the production of high quality steels. In addition to producing a high quality steel comparable to a vacuum degassed steel, the process of this invention is less costly than argon degassing practices, and does not require specialized equipment.

DESCRIPTION OF THE PREFERRED EMBODIMENT

In accordance with the preferred practice of this invention, a heat of steel produced by any conventional process, e.g. open hearth, electric, BOP or Q-BOP, is deoxidized while it is being tapped from the steelmaking vessel by a unique practice which forms large non-metallic inclusions, and thereafter blown with argon, or other suitable inert gas to remove the non-metallic inclusions. Specifically, the heat of steel may be produced pursuant to any known practice and may be either a high or low carbon steel. In view of the fact that the steel will eventually be blown with argon at ambient temperatures, the steel's tap temperature should be adjusted upwardly to compensate for the cooling effect on blowing, as discussed below. Before the steel is tapped from the steelmaking vessel, a controlled amount of a strong deoxidizer, preferably aluminum, is deposited in the tap ladle. As an alternative, the deoxidizer may be added to the tapped steel while the first one-third volume of steel is being tapped. During the period of time while the later two-thirds volume of steel is being tapped, normal deoxidizing additions of manganese and silicon are added to the steel in the ladle.

The amount of aluminum added prior to or during the first third of the tap must be carefully controlled in direct proportion to the steel's oxygen content. Since the oxygen content of the liquid steel is not usually measured, the aluminum addition may be determined approximately in inverse proportion to the carbon content. Generally, the aim aluminum addition should be: Al (lbs/200 tons)=k/Tap carbon (%). However, k also changes with carbon content and consequently, a curve relating total product oxygen and carbon content of the liquid steel has been used to determine the optimum amount of aluminum needed to react with a particular amount of oxygen at each carbon content. Table I below provides the preferred aim aluminum addition in pounds per 200 tons of steel as a function of the steel's carbon content. Although it is preferred that the aim amount of aluminum be added as little as 50 lbs. less than the aim is permissible.

TABLE I

Aim Aluminum Addition for Silicon-Killed Steels

| Carbon Content, percent | Aim Aluminum, FIG. 2, lb/200 tons of steel |
|---|---|
| 0.03 | 780 |
| 0.04 | 700 |
| 0.05 | 620 |
| 0.06 | 550 |
| 0.07 | 470 |
| 0.08 | 400 |
| 0.09 | 370 |
| 0.10 | 330 |
| 0.12 | 290 |
| 0.14 | 260 |
| 0.16 | 240 |
| 0.18 | 225 |
| 0.20 | 210 |
| 0.22 | 200 |
| 0.24 | 185 |
| 0.30 | 160 |
| 0.32 | 150 |
| 0.40 | 135 |
| 0.42 | 130 |

TABLE I-continued

| Aim Aluminum Addition for Silicon-Killed Steels | |
|---|---|
| Carbon Content, percent | Aim Aluminum, FIG. 2, lb/200 tons of steel |
| 0.50 | 115 |
| 0.52 | 115 |
| 0.60 | 110 |
| >0.60 | 110 |

The deoxidation practice effected during the later two-thirds of the tap consists of adding the proper amount of ferromanganese and ferrosilicon (or other ferroalloy) additions to obtain the proper steel chemistry. If the slag from the furnace is withheld from the ladle, a synthetic reducing slag (600 to 800 lbs.) should be added. If furnace slag is tapped on to the ladle, the slag should be neutralized by addition of lime in the ratio of about 1 part for every 3 or 4 parts of furnace slag. This is to prevent reoxidation of the steel during the subsequent argon treatment.

After the molten steel in the tap ladle has been covered by the slag as noted above, it should be rinsed by blowing argon or other suitable inert gas therethrough. While any injection hardware should suffice, we have preferred to use a hollow dummy stopper rod having a plurality of small holes near the bottom to assure small argon bubbles. Ideally, the argon flow rate should be about 6 to 8 scfm (0.18 to 0.24 $m^3$/min.) which is slightly less than the rate normally used in argon stirring for temperature homogenization. The injection period should be continued for at least nine minutes, up to about twenty minutes. Injection periods of less than nine minutes may be insufficient to cleanse the steel to the extent possible, while injection times of more than twenty minutes will unduly cool the steel without providing any appreciable benefit. The total argon injection is therefore normally less than one cubic foot per ton of steel which is considerably less than conventional argon degassing practices. This relatively small amount of argon usage not only renders the process more economical but also provides the added benefit that steel cooling during argon injection is minimized. Specifically, during the first three to five minutes of the blow, the steel, at the top of the ladle, cools 25° to 30° F. This is due primarily to the mixing of cooler steel from the lower portions of the ladle. Once the temperature is uniform, the argon treatment with cause a temperature drop of about 1.8° F. per minute as compared to 1.0° F. per minute with no gas injection.

Steel deoxidized and argon rinsed pursuant to the above practice will have a cleanliness quality equal to or better than steels processed through vacuum degassing apparatus. Despite the fact that substantial quantities of aluminum are added, the final product steel will typically contain less than 0.002% aluminum. This improved result depends from a combination of circumstances. Firstly, the relatively large amount of aluminum added to the steel while the steel's oxygen content is high, favors the formation of solid dendritic alumina inclusions. These dendritic alumina inclusions are much larger than the manganese silicates that ordinarily result from manganese and silicon deoxidation, and therefore float out to the ladle slag much faster than manganese silicates. To facilitate flotation, the dentritic alumina typically has extended arms with a length up to forty times the diameter. Other inclusions that ordinarily do not rapidly float out because they are small or because they are caught in convection currents in the ladle are also swept by rising argon bubbles to the slag where they can be discarded. The argon rinse provides a gentle flow upward along the entry rod to the slag layer and downward currents along the sides of the ladle. Non-metallics that are contacted by the argon bubbles are floated quickly to the slag layer. Other non-metallics enter the established flow pattern and, thus, are circulated eventually to the slag layer.

In view of the above-described mechanisms, it is obvious that a minimum amount of aluminum must be provided and that a minimum time to permit adequate flotation of non-metallics must be provided. Experience with our facilities has shown the minimum aluminum to be as discussed above and the minimum time to be nine minutes. It is also essential that the argon flow rate be minimized to no more than 10 scfm (0.3 $m^3$/min.) and preferably 6 to 8 scfm (0.18 to 0.24 $m^3$/min.). Flow rates in excess of 10 scfm produces excessive turbulence, which exposes more steel to the atmosphere thereby causing excessive steel reoxidation. For optimum results, we have preferred to lower the entry rod vertically at a point about one-third a diameter with the rod base one foot from the ladle bottom. The argon flow should be initiated before the lance or rod is immersed to prevent steel back-fill into the rod. If the turbulent area around the lance or rod exceeds about a two- to three-foot diameter, we have reduced the flow rate to maintain such limit. Injection may be interrupted by removing the lance or rod without stopping gas flow for temperature checks, etc.

EXAMPLES

To aid in a fuller understanding of this invention, the following description exemplifies one series of tests to establish the critical parameters of the inventive process. In these tests, fifty electric furnace heats of silicon-killed coarse-grained steel intended for continuous casting were treated. Ordinarily, this quality steel is DH-degassed. These fifty heats had carbon contents ranging from 0.08 to 0.49%. The argon injection was performed at a station normally used for argon stirring to effect temperature homogenization prior to continuous casting. Injection was effected through a hollow dummy stopper rod with a one-fourth inch diameter hole. For a few heats the single hole in the stopper-rod head was plugged, and numerous smaller holes, (from 25 to 40), were provided in the sides near the base. The amounts of aluminum added, argon injection rates and injection times were varied to study the effects thereof.

In each test argon flow was initiated before the hollow rod was immersed and continued at about 10 scfm (0.3 $m^3$/min.) or less. Normal treatment time for temperature homogenization is three to five minutes, but twenty-six of the fifty heats were argon treated for more than five minutes, both to establish the effect of longer treatment time and to decrease the temperature to acceptable casting levels.

These heats were monitored for temperature loss during argon treatment. The apparent drop in temperature near the top of the ladle due to mixing with colder steel at the bottom of the ladle was about 25° to 30° F. ($\Delta$° C.$=1.8\Delta$° F.) in the first three to five minutes of argon treatment. Temperature drop thereafter was about 1.8° F. per minute while argon was flowing and 1° F. with no argon treatment. Thus, for a twenty-minute treatment time, the temperature drop was approximately 55° F. This compares favorably with the temperature drop during DH-degassing for about the same treatment time.

Specimens from the fifty heats were studied in the laboratory for microcleanliness using neutron activation oxygen determination and the standard quantitive television microscope (QTM) method, and rated according to conventional practices.

Table II below briefly summarizes the fifty tests and the results thereof.

TABLE II

Data for Argon-Treated Silicon-Killed Nondegassed Continuous Cast Steels

| Cast No. | Product Carbon, % | Product Total Al, % | Al Added, lb | Preferred Aim Al,* lb | Argon Treatment Time,* min. | Classification |
|---|---|---|---|---|---|---|
| 3460 | 0.23 | <0.002 | 100 | 190 | 3 | Low time, Low Al* |
| 3461 | 0.18 | <0.002 | 100 | 225 | 3 | Low time, Low Al |
| 3594 | 0.20 | 0.002 | 100 | 210 | 15 | Low Al |
| 3596 | 0.20 | 0.002 | 100 | 210 | 3 | Low time, Low Al |
| 3815 | 0.08 | <0.002 | 400 | 400 | 6 | Low time |
| 3818 | 0.11 | <0.002 | 500 | 310 | 14 | Rinsed |
| 3984 | 0.10 | 0.004 | 400 | 330 | 2 | Low time |
| 4068 | 0.10 | 0.008 | 500 | 330 | 5 | Low time |
| 4069 | 0.08 | <0.002 | 400 | 400 | 19 | Rinsed |
| 4075 | 0.30 | 0.008 | 200 | 160 | 6 | Low time |
| 4245 | 0.22 | <0.002 | 100 | 200 | 6 | Low time, Low Al |
| 4246 | 0.24 | <0.002 | 100 | 190 | 1 | Low time, Low Al |
| 4248 | 0.23 | <0.002 | 150 | 190 | 5 | Low time, Low Al |
| 4250 | 0.18 | 0.002 | 150 | 225 | 1 | Low time, Low Al |
| 4251 | 0.19 | 0.002 | 150 | 215 | 8 | Low time, Low Al |
| 4252 | 0.17 | <0.002 | 150 | 230 | 4 | Low time, Low Al |
| 4254 | 0.22 | <0.002 | 150 | 200 | 5 | Low time, Low Al |
| 4256 | 0.24 | 0.002 | 200 | 190 | 8 | Low time |
| 4321 | 0.26 | <0.002 | 0 | 185 | 9 | Low Al |
| 4322 | 0.23 | 0.005 | 100 | 190 | 9 | Low Al |
| 4471 | 0.39 | 0.006 | 125 | 135 | 6 | Low time |
| 4472 | 0.31 | 0.002 | 150 | 155 | 2 | Low time |
| 4479 | 0.22 | <0.002 | 100 | 200 | 2 | Low time, Low Al |
| 4480 | 0.23 | <0.002 | 100 | 190 | 2 | Low time, Low Al |
| 4482 | 0.24 | <0.002 | 100 | 190 | 4 | Low time, Low Al |
| 4483 | 0.22 | <0.002 | 100 | 200 | 2 | Low time, Low Al |
| 4484 | 0.21 | 0.003 | 100 | 205 | 6 | Low time, Low Al |
| 4616 | 0.28 | 0.003 | 125 | 170 | 8 | Low time, Low Al |
| 4618 | 0.34 | <0.002 | 100 | 140 | 4 | Low time, Low Al |
| 4619 | 0.20 | 0.002 | 100 | 210 | 2 | Low time, Low Al |
| 4647 | 0.22 | <0.002 | 175 | 200 | 20 | Rinsed |
| 4665 | 0.22 | 0.002 | 50 | 200 | 1 | Low time, Low Al |
| 4666 | 0.44 | 0.005 | 150 | 125 | 9 | Rinsed |
| 4667 | 0.25 | 0.003 | 200 | 185 | 5 | Low time |
| 4670 | 0.22 | 0.004 | 100 | 200 | 7 | Low time, Low Al |
| 4683 | 0.22 | <0.002 | 175 | 200 | 12 | Rinsed |
| 4767 | 0.49 | <0.002 | 50 | 115 | 2 | Low time, Low Al |
| 4775 | 0.23 | 0.002 | 200 | 190 | 20 | Rinsed |
| 4785 | 0.23 | 0.006 | 350 | 190 | 9 | Rinsed |
| 4786 | 0.21 | 0.010 | 200 | 205 | 12 | Rinsed |
| 4801 | 0.21 | <0.002 | 200 | 205 | 20 | Rinsed |
| 4802 | 0.27 | <0.002 | 150 | 170 | 14 | Rinsed |
| 4805 | 0.17 | 0.002 | 150 | 230 | 12 | Low Al |
| 4806 | 0.20 | 0.002 | 150 | 210 | 11 | Low Al |
| 4810 | 0.30 | 0.002 | 150 | 160 | 3 | Low time |
| 4816 | 0.19 | 0.002 | 200 | 215 | 5 | Low time |
| 4817 | 0.25 | <0.002 | 150 | 185 | 19 | Low Al |
| 4818 | 0.24 | <0.002 | 200 | 185 | 13 | Rinsed |
| 4821 | 0.26 | 0.003 | 200 | 185 | 4 | Low time |
| 4822 | 0.17 | <0.002 | 150 | 230 | 15 | Low Al |

*Al aim per Table I.

Table II above shows the steel's carbon content, the total aluminum added, the aluminum remaing in the product and the preferred aluminum addition as subsequently established per Table I. The argon treatment time is also shown. The "Classification" column is a simple summary of the results and/or the cause thereof. Specifically, those heats identified as "rinsed" had microcleanliness characteristics equal to or better than DH-degassed steels. Those not classified as "rinsed" had microcleanliness values less the DH-degassed steels and the reason therefore is shown in the Classification column, e.g., "low time" meaning that the heat was not argon treated for a sufficient time and so on. It can be seen that those heats classified as "rinsed" had received the minimum prescribed aluminum addition during tapping per Table I and had been argon treated for nine minutes or more.

To further illustrate the advantages of this invention, Table III below provides the final oxygen contents and the QTM microcleanliness values for those heats classified as rinsed and contrasts those values with typical values routinely determined for comparable carbon contents for DH-degassed heats.

TABLE III

Comparison of Product Through-Thickness Oxygen and Microcleanliness Parameters of Nondegassed, Argon Rinsed, and DH-Degassed Immersed-Poured Steels

| Carbon Content, % | Processing | Cast No. | No. of Casts | Oxygen, ppm | QTM Microcleanliness Quarter/Center Volume % | Length Factor |
|---|---|---|---|---|---|---|
| 0.06–0.09 | Rinsed, Nondegassed | 4069 | — | 77 | 0.05/0.05 | 14/12 |
| | DH-Degassed | — | 20 | 103 | 0.11/0.13 | 29/40 |
| 0.10–0.14 | Rinsed, Nondegassed | 3818 | — | 50 | 0.04/0.06 | 0/3 |
| | DH-Degassed | — | 5 | 65 | 0.06/0.08 | 6/18 |
| 0.21–0.30 | Rinsed, Nondegassed | 4647 | — | 64 | 0.05/0.11 | 7/36 |
| | | 4683 | — | 66 | 0.15/0.20 | 23/37 |
| | | 4775 | — | 58 | 0.07/0.10 | 2/10 |
| | | 4785 | — | 42 | 0.06/0.08 | 2/16 |
| | | 4786 | — | 33 | 0.18/0.20 | 1/10 |
| | | 4801 | — | 113 | 0.15/0.26 | 14/56 |
| | | 4802 | — | 119 | 0.05/0.20 | 12/57 |
| | | 4818 | — | 42 | 0.03/0.04 | 4/3 |
| | DH-Degassed | — | 78 | 69 | 0.10/0.14 | 19/37 |
| 0.40–0.50 | Rinsed, Nondegassed | 4666 | — | 46 | 0.05/0.09 | 0/8 |
| | DH-Degassed | — | 10 | 43 | 0.07/0.07 | 12/8 |
| | Ratio ≦ Degassed/Total | | | 8/11 | 6/11 | 8/11 |

From Table III it can be determined that of those steels processed according to this invention, 73% had oxygen content and length factor values equal to or better than typical DH-degassed steels, and 55% had volume % values equal to or better than DH-degassed steels. This data is shown in Table IV below contrasted to comparable data from the other heats not classified as "rinsed".

TABLE IV

Percent of Argon-Treated Casts With Oxygen or Microcleanliness Equal to or Better Than DH Degassed Casts

| Processing | No. of Casts | Percent Equal to or Better Than DH: Oxygen | Volume % | Length Factor |
|---|---|---|---|---|
| Rinsed | 11 | 73 | 55 | 73 |
| Stirred, Low Time | 11 | 55 | 55 | 64 |
| Stirred, Low Al | 7 | 0 | 14 | 14 |
| Stirred, Low Time, Low Al | 21 | 5 | 14 | 19 |

From Table IV it can be seen that the results with those heats classified "low time" were reasonably good with oxygen and microcleanliness parameters 55 to 64% equal to or better than DH-degassed steels. Accordingly, treatment time could be somewhat less than nine minutes and be adequate, although some decrease in reproducibility could be expected.

We claim:

1. A process for deoxidizing a steel to produce exceptional microcleanliness comprising, tapping a heat of molten steel into a vessel, adding a predetermined amount of aluminum to the steel in the vessel before the first one-third volume of steel is tapped, said predetermined amount being from about 110 to about 780 pounds per 200 tons of steel in inverse proportion of the steel's carbon content within the range 0.03 to 0.60 percent carbon, adding ferromanganese and ferrosilicon while the final two-thirds volume of steel is being tapped as necessary to meet the required steel composition, providing a non-oxidizing slag on the tapped steel, injecting an inert gas through the steel at a rate no greater than 10 scfm for a period of about 9 to 20 minutes to provide at least about 0.3 but not more than about 1 cubic foot of inert gas per ton of steel.

2. A process according to claim 1 in which said aluminum is added to the vessel before the steel is tapped.

3. A process according to claims 1 or 2 in which the maximum aluminum addition is approximately as specified in Table I of the specification, and the minimum aluminum addition is not more than 50 pounds less than specified in Table I.

4. A process according to claim 3 in which said inert gas is injected at a rate of from 6 to 8 scfm.

* * * * *